US008579146B2

(12) United States Patent
Tatarek

(10) Patent No.: US 8,579,146 B2
(45) Date of Patent: Nov. 12, 2013

(54) GAS STORAGE APPARATUS

(75) Inventor: Andrew Richard Thomas Tatarek, Aldershot (GB)

(73) Assignee: Linde Aktiengesellschaft, Munich (DE)

( * ) Notice: Subject to any disclaimer, the term of this patent is extended or adjusted under 35 U.S.C. 154(b) by 89 days.

(21) Appl. No.: 13/166,832

(22) Filed: Jun. 23, 2011

(65) Prior Publication Data

US 2012/0151943 A1 Jun. 21, 2012

(30) Foreign Application Priority Data

Jul. 2, 2010 (GB) ..... 1011212.6

(51) Int. Cl.
*F17C 1/12* (2006.01)

(52) U.S. Cl.
USPC ..... 220/592.24; 220/592.28; 220/592.26; 220/586; 62/457.2

(58) Field of Classification Search
USPC ..... 220/592.28, 592.26, 592.23, 592.24, 220/586, 581; 62/457.2, 371
See application file for complete search history.

(56) References Cited

U.S. PATENT DOCUMENTS

| | | | | |
|---|---|---|---|---|
| 1,664,702 | A * | 4/1928 | Osborn | 62/316 |
| 3,786,777 | A * | 1/1974 | Smith et al. | 116/206 |
| 6,422,032 | B1 * | 7/2002 | Greene | 62/457.2 |
| 6,701,742 | B2 * | 3/2004 | Mack et al. | 62/430 |
| 7,089,757 | B2 * | 8/2006 | Yang | 62/457.4 |
| 7,260,956 | B1 * | 8/2007 | Schabron et al. | 62/371 |
| 7,344,767 | B2 * | 3/2008 | Giori et al. | 428/35.7 |
| 2005/0238672 | A1 * | 10/2005 | Nimni | 424/400 |

FOREIGN PATENT DOCUMENTS

| | | |
|---|---|---|
| CA | 1 061 578 | 9/1979 |
| FR | 2 897 413 | 8/2007 |
| GB | 1561831 | 3/1980 |
| NL | 1 018 810 | 2/2003 |

OTHER PUBLICATIONS

Translated from the Dutch NL 1018810C (PTO 13-5330), Date of application: Jun. 23, 2001,Date of translation: Aug. 8, 2013, Translator: John Koytcheff.*
International Search Report for PCT/GB2011/000995, Date of Mailing: Sep. 6, 2011, Authorized Officer: Boris Nicol, 10 pp.

* cited by examiner

*Primary Examiner* — Stephen Castellano
(74) *Attorney, Agent, or Firm* — David A. Hey

(57) ABSTRACT

A gas storage apparatus comprises a pressure vessel in the form of a cylinder, closed by a valve, containing a non-permanent gas having under its storage conditions a gas phase and a liquid phase. A jacket formed of plastics sachets surrounds and is in heat transfer relationship with the outer surface of the cylinder. The sachets define closed compartments containing a heat release substance which is liquid at 20° C. On opening the valve, the non-permanent gas is delivered from the cylinder. The liquid phase of the non-permanent gas absorbs heat from the heat release substance which undergoes fusion. The heat release substance may be water.

18 Claims, 5 Drawing Sheets

GAS STORAGE APPARATUS

FIELD OF THE INVENTION

This invention relates to a gas storage apparatus for storing under pressure a non-permanent gas with some of the gas being present in a liquid phase and the rest in a gas phase.

BACKGROUND OF THE INVENTION

Pressurised gas storage vessels are very well known and are often called "gas cylinders" even if not of cylindrical shape. The pressurised gas storage vessel can be used to store a permanent gas, that is a gas which cannot be liquefied by the application of pressure alone, or a non-permanent gas, that is a gas which can be liquefied by the application of pressure alone. Examples of non-permanent gases are carbon dioxide and nitrous oxide.

Particular problems, which will be outlined below, can arise when supplying a non-permanent gas from a pressurised gas storage vessel containing the non-permanent gas in liquid state under the pressure of a gaseous phase. Because the molecules of the non-permanent gas will be contained in the liquid phase, it is necessary, if it is desired to supply the substance in the gaseous phase, to cause the liquid phase to vaporise. Such vaporisation occurs naturally while gas is withdrawn from the pressure vessel. The boiling liquid absorbs heat from the walls of the pressure vessel. The vessel has a given thermal mass and with large gas cylinders, say having a water capacity from 5 liters to 10 liters, and normal demand rates, this thermal mass and its surface area are sufficient to meet the demand for the gas. With vessels of a much smaller capacity, say, less than 1 liter, there is a lower thermal mass than surface area on which the boiling liquid can draw. In practice, depending on the rate of gas removal, small cylinders can reach low temperatures such as −30 to −700 C. As a result, the cylinders become potentially hazardous as they would create a cold burn if they came into all but the most fleeting contact with human skin. Further, low temperatures can cause problems downstream, through condensation on the equipment and the hardening and thus leakage of elastomeric seals.

One example of the difficulties that can arise in supplying a non-permanent gas from a cylinder is now given. It is desirable to store nitrous oxide in relatively small cylinders because these are easier to handle than in larger ones. A cylinder having a 0.5 l contains 240 g of nitrous oxide in the liquid phase, nominally enough for 20 minutes of delivery to a typical adult undergoing analgesia or anaesthesia with nitrous oxide. The latent heat of vaporisation of nitrous oxide at 00 C is about 250 kJ/kg. The total heat of evaporation is approximately 60 kJ in this example. Over 20 minutes of analgesia, this would typically average 50 W of cooling. The thermal mass of a typical aluminium cylinder and valve in a cylinder having a 0.5 l water capacity is 450 J/K. Without any heat transfer to the outside, the temperature drop of the cylinder during withdrawal of the nitrous oxide would be 60 kJ/450 J/K which is approximately 133K.

In practice, the temperature drop would be less than this, perhaps only 80K in total, as there will be some heat transfer from the surroundings of the cylinder, and some demand for heat will be lost with the gaseous nitrous oxide as it is delivered to a patient. However, a temperature drop of 80K is unacceptable because the external surface of the cylinder would be unsafe to touch owing to its low temperature and as the freezing point of nitrous oxide is approximately −80 C, there would be a risk of the nitrous oxide actually freezing within the cylinder. Further, many elastomeric sealing materials harden and leak if subject to a temperature less than −300 C.

Simple solutions to the problem are not effective. Thermally insulating the exterior of the cylinder would protect the user from cold burns, but exacerbate the temperature drop within the cylinder. Taking the nitrous oxide from the cylinder as a liquid, for example, via a dip-tube would have the advantage of substantially lessening the cooling effect on the cylinder, but displacing it to another place in the gas deliver equipment, for example, in a regulator, where there may be substantially less heat capacity with the result that even larger temperature drops may occur, causing freezing and condensation. Increasing the weight of the cylinder would reduce the temperature drop, but this may add unacceptably to the overall weight of the equipment.

Canadian Patent No. 1 061 578 relates to the supply of carbon dioxide from small pressurised gas capsules of the kind having a sealed mouth instead of a valve. According to Canadian Patent No. 1 061 578, a container is provided to hold a buffer substance, the container being in a heat conductive relationship with the capsule. The buffer substance is one that undergoes a change in its physical, chemical, crystallographic or other state at a temperature between ambient temperature and the final operating temperature of the capsule, the change of state causing a release of heat to the boiling liquefied gas. The heat is typically derived from latent heat of fusion of the buffer substance. The container of buffer substance may be located within the gas storage vessel or outside of it. If located externally, the container may take a form of jacket surrounding the vessel. The jacket is not self-defined, that is it holds the buffer substance in direct physical contact with the exterior of the gas storage vessel. This arrangement has a number of disadvantages. Prolonged contact of the buffer substance with the gas vessel may cause corrosion or erosion of the surface of the latter. Further, over a period of time the buffer substance becomes depleted by evaporation.

SUMMARY OF THE INVENTION

According to the present invention there is provided gas storage apparatus comprising a pressure vessel containing a non-permanent gas having under its storage conditions a gas phase and a liquid phase, a valve closing the pressure vessel, a jacket surrounding and in heat transfer relationship with the outer surface of the pressure vessel, and a heat release substance stored within the jacket, the heat release substance being of a kind that when gas is dispensed from the pressure vessel releases heat to the said liquid phase by undergoing a change of state from liquid to solid, wherein the jacket has a configuration preventing physical contact between the pressure vessel and the heat release substance, and the jacket comprises a plurality of closed compartments which enclose the heat release substance and permit thermal currents to be established within the heat release substance when in liquid state.

The compartments are preferably closed essentially fluid-tight, though if made of plastics material may have a minimal permeability to water vapour. The heat release substance (typically water) is preferably subjected to degassing (e.g. by vacuum) prior to closure of the compartments.

The gas storage apparatus preferably comprises a plurality of closed plastics sachets containing the heat release substance, the plastics sachets surrounding the pressure vessel and being in physical contact therewith.

The plastics sachets are typically secured in place about the pressure vessel by means of adhesive tape or a sleeve. Alternatively, the plastics sachets may be stretched or heat shrunk about the pressure vessel.

The plastics sachets can be arranged so as to enable adequate heat release to the liquid phase when gas is being supplied from the pressure vessel.

The plastic sachets preferably have a minimum of free space. Accordingly, at least 95% of the free space of the plastic sachets is occupied by the heat release substance in liquid state (at a temperature of 200 C). Any gas space acts as an insulator and is therefore to be avoided. A further precaution is to degas the heat release substance prior to introduction into the sachets or prior to sealing of the sachets. Such a measure avoids an ullage space being created or enlarged in the sachets as a result of natural degassing during use.

Because plastics materials do not have high thermal conductivities, it is preferred that each sachet has thin walls. A typical wall thickness in contact with the pressure vessel is in the range 40-60 microns.

The plastics material is preferably one of relatively low permeability to the vapour phase of the heat release substance. It is also preferably transparent in order to permit viewing of writing or symbols on the pressure vessel. A suitable plastics material is polythene. Other suitable plastics materials include a laminate of polythene with nylon (for example, having eleven layers) or SURLYN™ plastics.

The heat release material is typically a substance which has a melting point in the range of 0-100 C and which is therefore in its liquid state at normal ambient temperatures. The function of the heat release substance is to prevent the liquid phase of the gas from sustaining a serious fall in temperature and pressure as it evaporates during delivery of gas. The heat release substance achieves this function by releasing heat to the liquefied gases as temperature attempts to fall.

Suitable heat release substances include acetic acid (melting point circa 160 C), formic acid (melting point 80 C) and water (melting point 00 C) and mixtures of these materials which allow other melting points to be achieved. The heat release substance, particularly of water, may also include anti-fungicide in order to prevent growth of fungi and algae in the sachets during use, or may be treated with UV radiation to the same end.

The gas storage apparatus typically additionally includes a cylindrical guard sleeve surrounding and spaced from the sachets. In this way the sachets are prevented from being punctured during normal handling of the vessel. The guard sleeve may be a one piece member or may comprise a plurality of members, for example, a pair of engaging semi-cylindrical members. The guard sleeve is typically formed of a transparent plastics material, particularly if it is desired to view writing or symbols on the exterior surface of the pressure vessel itself. The top of the guard sleeve typically engages a shoulder on the pressure vessel or the valve of the pressure vessel. It may also engage a base member in the form of a bowl in which the pressure vessel sits. Typically there is plastics sachet containing a heat release substance in thermal contact with the base of the pressure vessel. The plastics sachet at the base may be essentially the same as the other plastic sachets.

If the heat release substance is water, it may typically contain dissolved therein a substance which promotes crystallisation, for example, silver iodide.

The gas supply apparatus according to the invention facilitates the storage of substantial quantities of non-permanent gas in lightweight vessels without giving rise to problems of restricted flow of the non-permanent gas when it is delivered from the pressure vessel and without creating unduly low temperatures at the surface of the pressure vessel.

BRIEF DESCRIPTION OF THE DRAWINGS

A gas storage according to the invention will now be described by way of example with reference to the accompanying drawings, in which.

The drawings are not to scale.

DETAILED DESCRIPTION OF PREFERRED EMBODIMENTS

Figure 1:
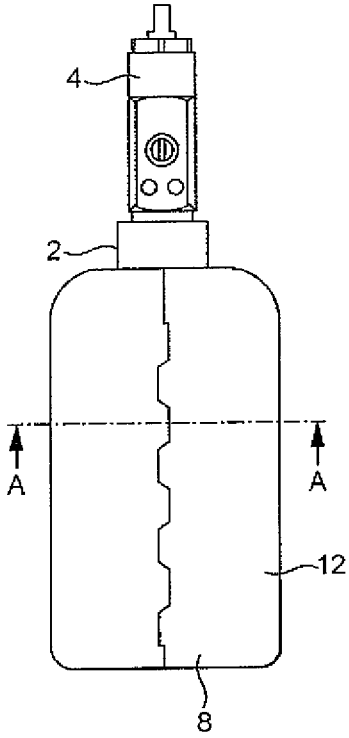
FIG. 1 is a schematic side view of a first gas supply apparatus according to the invention.
Figure 2:
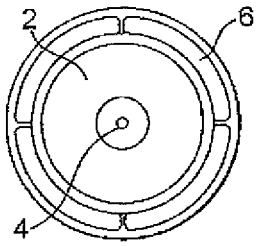
FIG. 2 is a cross-section through the line AA shown in FIG. 1.
Figure 3:
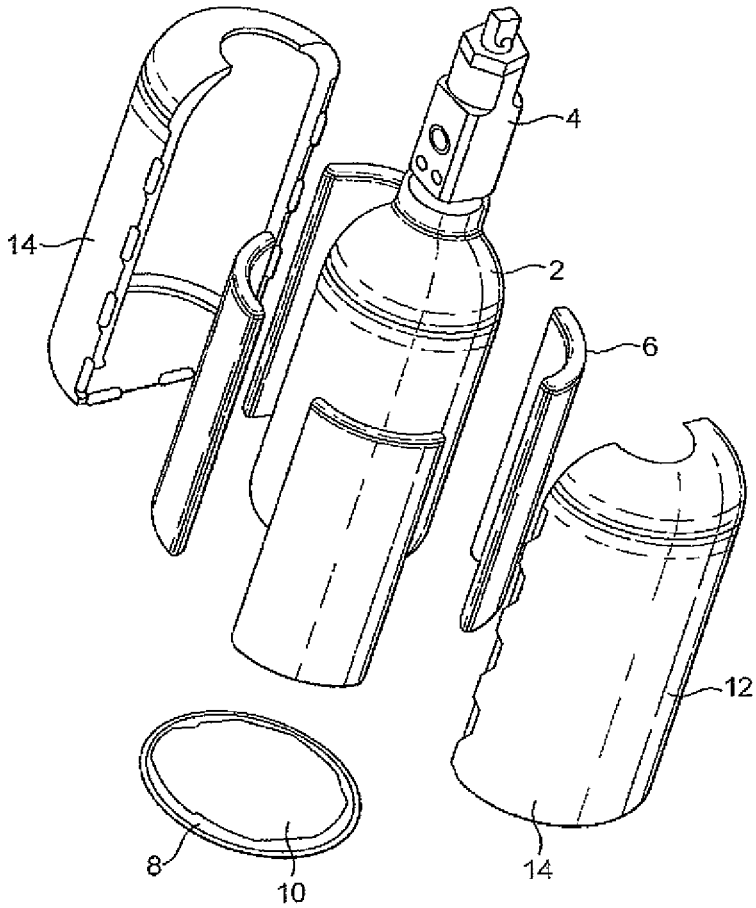
FIG. 3 is a schematic exploded perspective view of the apparatus shown in FIGS. 1 and 2.

Referring to FIGS. 1 to 3, the illustrated gas release apparatus comprises a pressure vessel in the form of lightweight gas cylinder 2, typically formed of aluminium. The cylinder typically has a water capacity of 1 l or less, typically 0.5 l. The cylinder contains a non-permanent gas, for example, nitrous oxide or carbon dioxide. The non-permanent gas is stored under pressure and is present both in the gaseous phase and the liquid phase, most of the molecules of the non-permanent gas being present in the liquid phase. The total weight of a full cylinder 2 is such that it can be readily lifted and held by hand. The cylinder 2 may therefore be made of, for example, aluminium.

The cylinder is closed by a valve 4, which may be manually or automatically operable to deliver gas, when desired. The valve 4 may be of the tamper-proof kind described in WO-A-2009/125180, the disclosure of which is incorporated herein by reference. The gas cylinder 2 is not provided with a dip tube. Accordingly, when the valve 4 is opened, expansion of the gaseous phase results in a reduction of the pressure and hence evaporation of the liquid phase. Such evaporation is required in order to continue to supply nitrous oxide at a desired rate, for example, for use in providing analgesia or anaesthesia to an adult human being of normal weight.

The problems to be overcome in maintaining supply of the nitrous oxide or other non-permanent gas have been described above. In order to combat these problems, the cylinder 2 has wrapped around its external surface a jacket in the form of an arrangement of four closed plastics sachets 6 each defining a closed compartment filled with a heat release substance which is a liquid at 200 C. The sachets 6 are in good thermal contact with the external surface of the gas cylinder 2 over a substantial part of its surface area but prevent physical contact between the heat release substance and the cylinder 2. The area of the cylinder 2 in contact with the plastic sachets 6 in one example might be 60 mm in diameter by 150 mm in length. If the cylinder 2 is a 0.5 l cylinder containing 240 g of nitrous oxide in the liquid phase and it is delivered at a steady rate over a period of 20 minutes, approximately 50 W of heat is required. For a typical plastics material, if the thickness in thermal contact with the cylinder 2 is, say, 1 mm, a temperature difference of about 9K is required. Much smaller temperature differences are, however, desirable. Accordingly, the thickness of each sachet in thermal contact with the cylinder 2 is much less than 1 mm and is typically in the order of 50 microns (50×10−6 m). Now the thermal gradient across the plastics is less than 1K.

Each sachet 6 is desirably essentially full of the heat release substance. There are two reasons in particular why this is so. First, air has a very poor conductivity of 0.024 W/mK, so any air gaps between the heat release substance and the material of the gas cylinder 2 would drastically reduce the rate of heat transfer and increase the thermal gradient. Second, the volume of liquid in thermal contact with surface of the gas cylinder 2 is thereby maximised, thus facilitating the establishment of thermal currents within the liquid heat release substance. Such thermal currents are of help in the transmission of heat from the surrounding environment to the liquid phase of the non-permanent gas through the medium of the heat release substance. The heat release substance therefore occupies at least 95% of the free volume of each plastics sachet 6 at 200 C.

The heat release substance is typically water. It may have dissolved therein additives such as anti-fungal agents and a crystallisation enhancer such as silver iodide. As shown in FIG. 3, there are typically four sachets 6. Each sachet may be preformed. Typically, each sachet 6 is formed from two sheets of plastics material welded together on three sides, but open on one so that it can be filled with the heat release substance. Once filled, the open end of the sachet can be sealed by welding. Each sachet 6 is therefore essentially impermeable to water vapour. Over a period of time there will be some small loss of water vapour from the sachets 6 by virtue of permeation of the water vapour through the plastics material from which the sachets 6 are formed. This material is therefore selected from plastics material that have a relatively low permeability to water vapour and/or treated so as to reduce this permeability; for example by being formed as a laminate of more than one sheet or coated with a barrier substance which reduces the permeability to water vapour of the sachets. (One possible coating material is tin oxide which has the advantage of being transparent.) If desired, the sachets may be replaced after a suitable period by fresh sachets filled with a heat release substance. This operation may be performed during routine maintenance/inspection of the apparatus shown in FIGS. 1 to 3.

If desired, each of the four sachets 6 may be welded together. If desired, this may be done before the sachets 6 are filled with the heat release substance. After filling and sealing, the sachets may be secured to the cylinder by means of adhesive tape or an elastic sleeve of suitable dimensions (neither of which is shown in FIG. 1-3).

The cylinder 2 is intended to be stood upon a base 8. If desired, a further plastic sachet 10 filled with a heat release substance such as water may be interposed between the base 8 and the bottom of the cylinder 2. Such an arrangement enhances the transfer of heat to the liquid phase of the non-permanent gas when the cylinder valve 4 is opened.

In order to shield the sachet 6 the cylinder 2 is provided with a cylindrical plastics guard 12 formed of two intermeshing semi-cylindrical members 14 of suitable plastics material such as polycarbonate. Both the material of the guard 12 and the sachet 6 may be clear and transparent so that markings (lettering or symbols) on the outer surface of the cylinder 2 may be read. Alternatively, the cylinder 2 may be provided with a display ring around the outer surface of its mouth at a position in which it is not obscured by the guard 8 and the sachets 6. The guard 12 may be formed to a precise shape such that it fits around the cylinder 2 and engages the base 8 without being provided with plugs or holes which engage complementary holes or lugs in the base 8.

If the outer surface of the cylinder 2 bears writing or symbols that need to be read, the materials from which the plastics sachets 6 and the plastics guard 12 are formed and the heat release substance all need to be sufficiently transparent to enable such writing or symbols to be clearly viewed. In one example, the sachets 6 are formed of a clear, transparent polyethylene, the guard 12 of clear, transparent polycarbonate, and the heat release substance is water.

Figure 4:
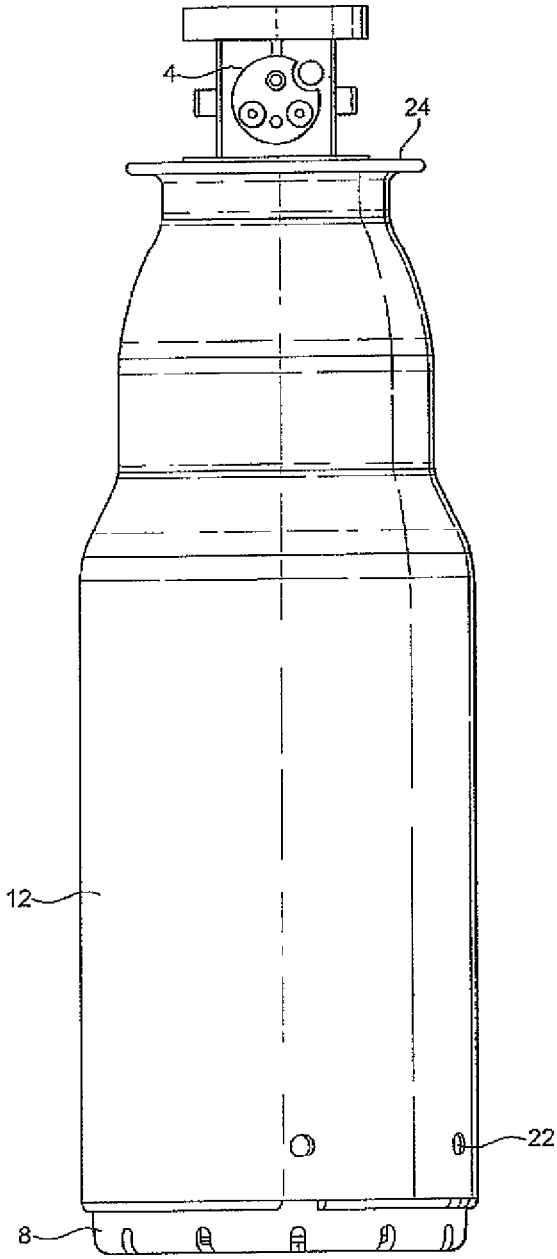
FIG. 4 is a side view of a second gas supply apparatus according to the invention.
Figure 5:
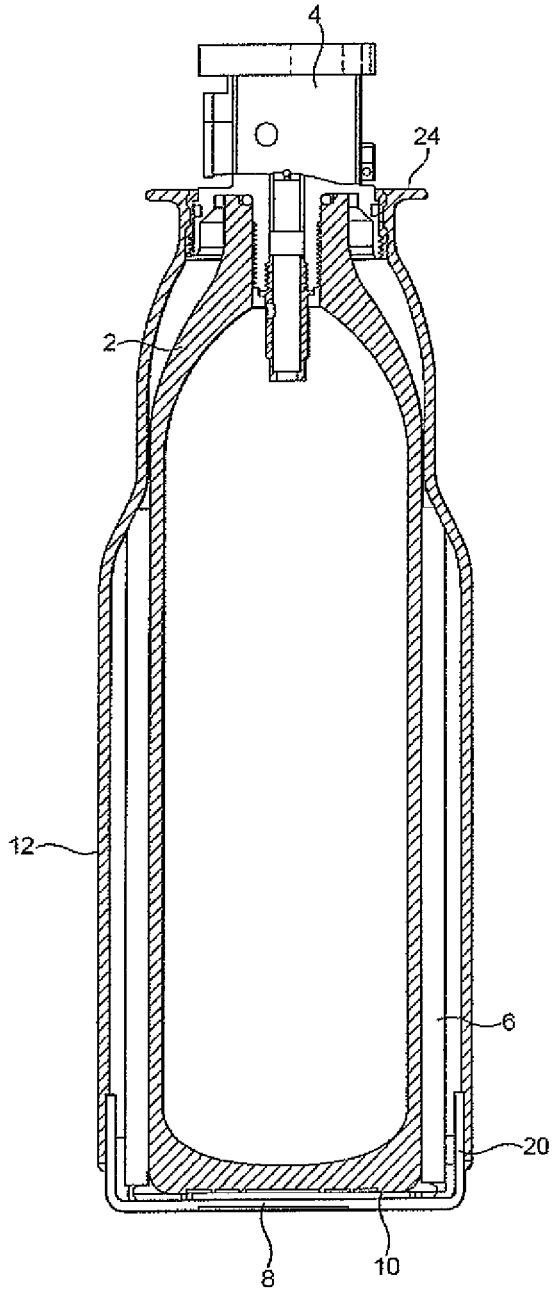
FIG. 5 is sectional side elevation of the apparatus shown in FIG. 4.
Figure 6:
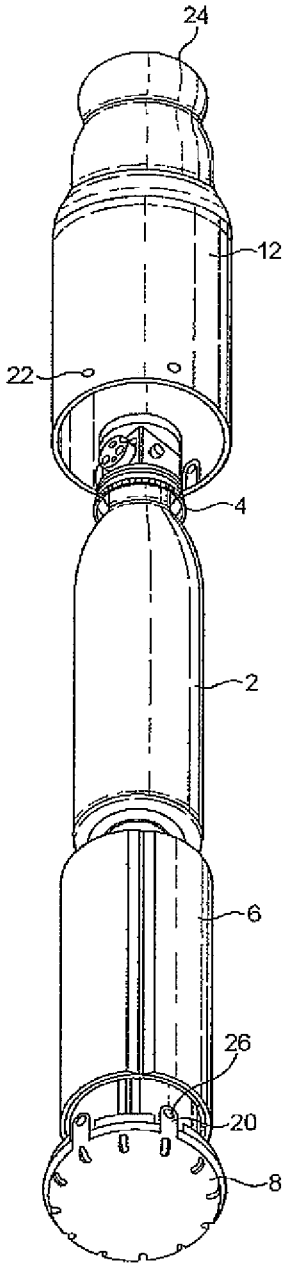
FIG. 6 is a schematic exploded perspective view of the apparatus shown in FIGS. 4 and 5.

An alternative arrangement is shown in FIGS. 4-6, which like parts to those shown in FIG. 1-3 are indicated by the same reference numerals as in FIGS. 1-3. Now, the base 8 is provided with integral posts 20 having complementary lugs 26 that engage apertures 22 at the bottom of the guard 12. The guard 12 is of narrower cross-section at its top than at its bottom. It is in screw-threaded engagement at its top with complimentary screw-threads formed on the body of the valve 4. The guard 12 is now formed of one piece rather than the two-piece construction shown in FIGS. 1-3. The guard 12 is provided at its top (as shown) with a flange 24 which functions as a handle.

In operation of the apparatus shown in FIGS. 1 to 3 or that shown in FIGS. 4 to 6, when it is desired to deliver gas from the cylinder 2 the valve 4 is opened, the resultant lessening of the pressure within the cylinder 2 causes the liquid phase of the non-permanent gas stored therein to vaporise. Heat for the vaporisation is drawn through the medium of the heat release substance held in the sachets 6 and 10. As a result of the heat being extracted from the heat release substance, it falls in temperature to its freezing point and then starts to fuse. The use of the heat release substance limits the temperature drop in the liquid phase of the non-permanent gas as it vaporises. The handle 24 in the form of apparatus shown in FIGS. 4-6 will always be close to ambient temperature and hence comfortable to touch. In order to keep down the cooling of the handle, there is typically an air gap between the main body of the guard 12 and the sachets 6. This keeps down the conduction of heat from the guard 14 into the interior of the cylinder 2. The apparatus shown in FIGS. 1-3 and the apparatus shown in FIGS. 4-6 are both capable of maintaining an adequate flow of nitrous oxide analgesic or anaesthetic to a patient over a full delivery period of the cylinder 2, which is typically twenty minutes. After the cylinder 2 has been essentially exhausted of nitrous oxide (that is to say, the storage pressure of nitrous oxide has fallen from a pressure, when the cylinder is full, of above 50 bar to a pressure of, say, less than 5 bar, the cylinder 2 may be taken out of service and refilled with nitrous oxide. The ice in the sachets 6 and 10 will gradually desorb heat while the cylinder 2 stands idle with the result that it melts again. If desired, the sachets 6 and 10 may be replaced when the cylinder 2 is refilled.

What is claimed is:

1. A gas storage apparatus comprising:

a pressure vessel containing a non-permanent gas, stored under conditions wherein both a gas phase and a liquid phase are present;

a valve closing the pressure vessel;

a jacket surrounding and in heat transfer relationship with the outer surface of the pressure vessel;

the jacket comprising a plurality of closed compartments each containing a heat release substance that releases heat to the liquid phase of the non-permanent gas by undergoing a change of state from liquid to solid.

2. The gas as storage apparatus according to claim 1, wherein the jacket is made of a plastic material that may be wrapped around the pressure vessel.

3. The gas storage apparatus according to claim 2 wherein the plastic material is transparent.

4. The gas storage apparatus according to claim 2, wherein the plastic material is polythene or a laminate of polythene and nylon.

5. The gas storage apparatus according to claim 1, wherein the jacket is secured in place around the pressure vessel by adhesive tape or a sleeve.

6. The gas storage apparatus according to claim 1, wherein the compartments sachets have at least 95% of their free space occupied by the heat release substance in liquid phase.

7. The gas storage apparatus according to claim 1, wherein the jacket has a wall thickness in contact with the pressure vessel in the range 40-60 microns.

8. The gas storage apparatus according to claim 1, wherein the compartments are welded together.

9. The gas storage apparatus according to claim 1, further comprising a cylindrical guard sleeve surrounding and spaced from the jacket.

10. The gas storage apparatus according to claim 9, wherein the guard sleeve engages a base member in which the pressure vessel sits.

11. The gas storage apparatus according to claim 1, wherein the heat release substance is water, acetic acid, formic acid or mixtures thereof.

12. The gas storage apparatus according to claim 1, wherein the heat release substance includes an anti-fungicide.

13. The gas storage apparatus according to claim 1, wherein the heat release substance includes a substance which promotes crystallisation.

14. The gas storage apparatus according to claim 13, wherein the crystallisation promotion substance is silver iodide.

15. The gas storage apparatus according to claim 1, further comprising compartment containing a heat release substance in thermal contact with the base of the pressure vessel.

16. A gas storage apparatus comprising;

a pressure vessel containing a non-permanent gas, stored under conditions wherein both a gas phase and a liquid phase are present;

a valve closing the pressure vessel;

a jacket surrounding and in heat transfer relationship with the outer surface of the pressure vessel;

the jacket comprising a plurality of closed compartments each containing a heat release substance that releases heat to the liquid phase of the non-permanent gas by undergoing a change of a state from liquid to solid;

further comprising a cylindrical guard sleeve surrounding and spaced from the jacket wherein the guard sleeve comprises a pair of engaging semi-cylindrical members.

17. A gas storage apparatus comprising:

a pressure vessel containing a non-permanent gas, stored under conditions wherein both a gas phase and a liquid phase are present;

a valve closing the pressure vessel;

a jacket surrounding and in heat transfer relationship with the outer surface of the pressure vessel;

the jacket comprising a plurality of closed compartments each containing a heat release substance that releases heat to the liquid phase of the non-permanent gas by undergoing a change of state from liquid to solid;

further comprising a cylindrical guard sleeve surrounding and spaced from the jacket wherein the guard sleeve is made of a transparent plastic material.

18. A gas storage apparatus comprising:

a pressure vessel containing a nonpermanent gas, stored under conditions wherein both a gas phase and a liquid phase are present;

a valve closing the pressure vessel;

a jacket surrounding and in heat transfer relationship with the outer surface of the pressure vessel;

the jacket comprising a plurality of closed compartments each containing, a heat release substance that releases heat to the liquid phase of the non-permanent gas by undergoing a change of state from liquid to;

further comprising a cylindrical guard sleeve surrounding and spaced from the jacket;

wherein the top of the guard sleeve engages a shoulder on the pressure vessel or on the valve.

* * * * *